United States Patent [19]

Wedeniwski

[11] Patent Number: 4,942,695

[45] Date of Patent: Jul. 24, 1990

[54] METHOD FOR CYLINDRICAL SURFACE GRINDING OF WORKSPACES

[75] Inventor: Horst J. Wedeniwski, Remshalden-Grunbach, Fed. Rep. of Germany

[73] Assignee: Fortuna-Werke Maschinenfabrik GmbH, Fed. Rep. of Germany

[21] Appl. No.: 258,850

[22] Filed: Oct. 17, 1988

[30] Foreign Application Priority Data

Oct. 19, 1987 [DE] Fed. Rep. of Germany ..... 3735343
Nov. 6, 1987 [DE] Fed. Rep. of Germany ..... 3737641

[51] Int. Cl.[5] ..... B24B 5/04

[52] U.S. Cl. ..... 51/165 R; 51/289 R; 51/105 R

[58] Field of Search ..... 51/105 R, 289 R, 165 R

[56] References Cited

U.S. PATENT DOCUMENTS 4,615,149 10/1986 Yoneda et al. ..... 51/289 R X

FOREIGN PATENT DOCUMENTS 3435313 9/1984 Fed. Rep. of Germany .
1474717 12/1974 United Kingdom .

OTHER PUBLICATIONS

Pamplet from Gühring Automation"—"DAS HSG--Programm, Sep. 1987.

G. Bunge, "Produktionssteigerung beim Aussenrundschleifen durch Verfahrens-variation", Journal Fertigungstechnik und Betrieb 23, vol. 3, Mar. 1973.

Dittmann und Gühring "Hochgeschwindigkeitsschleifen—Möglichkeit zur Produktivitätssteigerung bei der Metallbearbeitung", Journal Werkstatt und Betrieb 120, vol. 4, Apr. 1987.

*Primary Examiner*—Frederick R. Schmidt
*Assistant Examiner*—Bruce P. Watson
*Attorney, Agent, or Firm*—Walter A. Hackler

[57] ABSTRACT

A method serves for cylindrical surface grinding of workpieces. A grinding wheel engages a workpiece which rotates in the opposite direction and is fed at a given feeding speed parallel to the axis of the workpiece. The grinding wheel rotates about an axis which is inclined at an angle relative to the axis of the workpiece.

In order to achieve workpiece surfaces of low roughness at high machining speeds, in particular surfaces without spiral-shaped surface grooves, one first determines from the given surface roughness, by empirical means, a contact ratio serving as an auxiliary value whereafter the axial length of the first surface is determined and adjusted using a formula. The method is used within a range of values where workpiece diameters of 5 to 250 mm are encountered, the grinding wheel rotates at a speed of 100 to 300 m/s, the workpiece rotates at a circumferential speed of 65 to 200 m/s and the speed of the axial feed is between 150 to 2000 mm/min.

4 Claims, 1 Drawing Sheet

METHOD FOR CYLINDRICAL SURFACE GRINDING OF WORKSPACES

BACKGROUND OF THE INVENTION

The present invention relates to a method for cylindrical surface grinding of workpieces having a workpiece diameter ($d_w$) wherein a grinding wheel rotating at a circumferential speed ($v_s$) engages a workpiece rotating in the opposite direction at a circumferential speed ($v_w$), while the grinding wheel and the workpiece are fed relative to each other at a feeding speed ($v_{fa}$) along directions extending parallel to the axis of the workpiece, the grinding wheel rotating about an axis extending at an angle relative to the axis of the workpiece and the grinding wheel comprising first and second conical circumferential portions so that a first surface of the first circumferential portion engages a helicoidal material removal surface, while a second surface of the second circumferential portion engages an axial circumferential surface of the workpiece.

Methods of the type described before have been generally known and are used as a rule for an operation known as "plunge-cut grinding". In conventional plunge-cut grinding, relatively low circumferential speeds are selected for the grinding wheel and the workpiece, for example circumferential speeds in the range of 40 m/s.

It has been further known to use the method described before for peel grinding, which means that the outer circumference of the workpiece is ground from a raw dimension to a desired dimension, at relatively high material removal rates, by feeding the workpiece in the axial direction. The speed of the axial feed is extraordinarily low in this case, i.e. in the range of a few mm/min.

On the other hand, a high-speed grinding method has been known where a grinding wheel of relatively small thickness (for example 8 mm) is used and inclined in such a manner that one end face engages a radical shoulder face of the workpiece between the raw dimension and the final dimension, while its circumferential surface is inclined relative to the finished axial circumferential surface of the workpiece at a relief angle.

Although relatively high material removal rates can be achieved with the aid of these known high-speed grinding methods, the known method is connected with the drawback that due to the practically point-shaped contact between the grinding wheel and the foot of the radial end face of the workpiece at the transition to the finished circumferential surface, a spirally grooved surface of the workpiece is obtained which is unacceptable for many applications.

SUMMARY OF THE INVENTION

Now, it is the object of the present invention to improve a method of the type described above in such a manner that a uniform and precision-finished surface without any surface spirals and with a predetermined surface quality can be obtained at high material-removal rates.

This object is achieved by the steps of determining from a given surface roughness ($R_z$) of the workpiece a contact ratio (u) of the grinding wheel, and selecting thereafter the axial length ($l_N$) of the first surface using the formula $$l_N = U \cdot q \cdot \frac{\pi\, d_w}{6 \cdot 10^4} \cdot \frac{v_{fa}}{v_s}$$

wherein (q) is the quotient ($V_s/v_w$) of the circumferential speeds of the grinding wheel and the workpiece and the following value ranges are preferably selected:

$d_w$=5 to 250 mm $v_s$=100 to 300 m/s $v_w$=65 to 200 m/min $v_{fa}$=150 to 2000 mm/min.

The object underlying the present invention is solved in this manner fully and perfectly. The preferred value range with the extremely high circumferential speeds and speeds of feed permits to achieve material removal rates which are equal to the material removal rates of conventional machining processes using defined cutter faces (turning, milling). On the other hand, however, one achieves the advantages connected with machining methods using nondefined cutter faces (grinding), the grinding process giving rise only to very small granular chips, whereas the other machining processes using defined cutter faces, in particular turning processes, give rise to relatively big and long chips which may make themselves felt during turning as so-called coiling chips which—at least according to the present state of the art—exclude any automatic production processes which include turning operations. For, even modern turning machines require the presence of an operator who will clear the workpiece from coiling chips by means of a hook, in case coiling chips should occur.

The method according to the invention, therefore, can be described as a longitudinal-feed circumferential grinding process where the material is removed by geometrically undefined cutters. The machining oversize provides for a big cutting depth which is approximately 100 to 1000 times bigger than in the case of conventional longitudinal grinding. During circumferential grinding, one main cutter edge acts as end face of the grinding body, the axial feed being approximately 10 to 100 times greater than in the case of conventional longitudinal grinding. During surface grinding, a smoothing effect is achieved by a secondary cutter face, the axial length of the secondary cutter face being determined by qualification of the technological operating mechanisms.

Given the fact that this is not necessary in the case of the method according to the invention, the method of the invention opens up absolutely novel perspectives for automatic production operations which heretofore were exclusively reserved to drilling and milling processes.

A particular advantage is seen in this connection in the fact that the desired surface roughness can be predetermined within broad limits in the before-mentioned value range. For, it is the desired surface roughness from which a contact ratio is determined by means of empirically determined relations, which contact ratio serves as an auxiliary value from which the axial length of the first surface can be derived, using the geometry and the operating parameters of the workpiece and the grinding wheel as additional values. The length so determined can then be adjusted by appropriate selection of the grinding wheel so that minimum radial pressures, corresponding to the axial length of the first surface, will have to be exercised for achieving the desired surface roughness.

Other advantages of the invention will appear from the following description and the attached drawing.

It is understood that the features which have been described above and will be explained below may be used not only in the described combinations, but also in any other combination or individually, without leaving the scope and intent of the present invention.

DESCRIPTION OF THE DRAWINGS

One embodiment of the invention will be described hereafter in more detail with reference to the drawing in which.

DESCRIPTION OF THE PREFERRED EMBODIMENT

Figure 1:
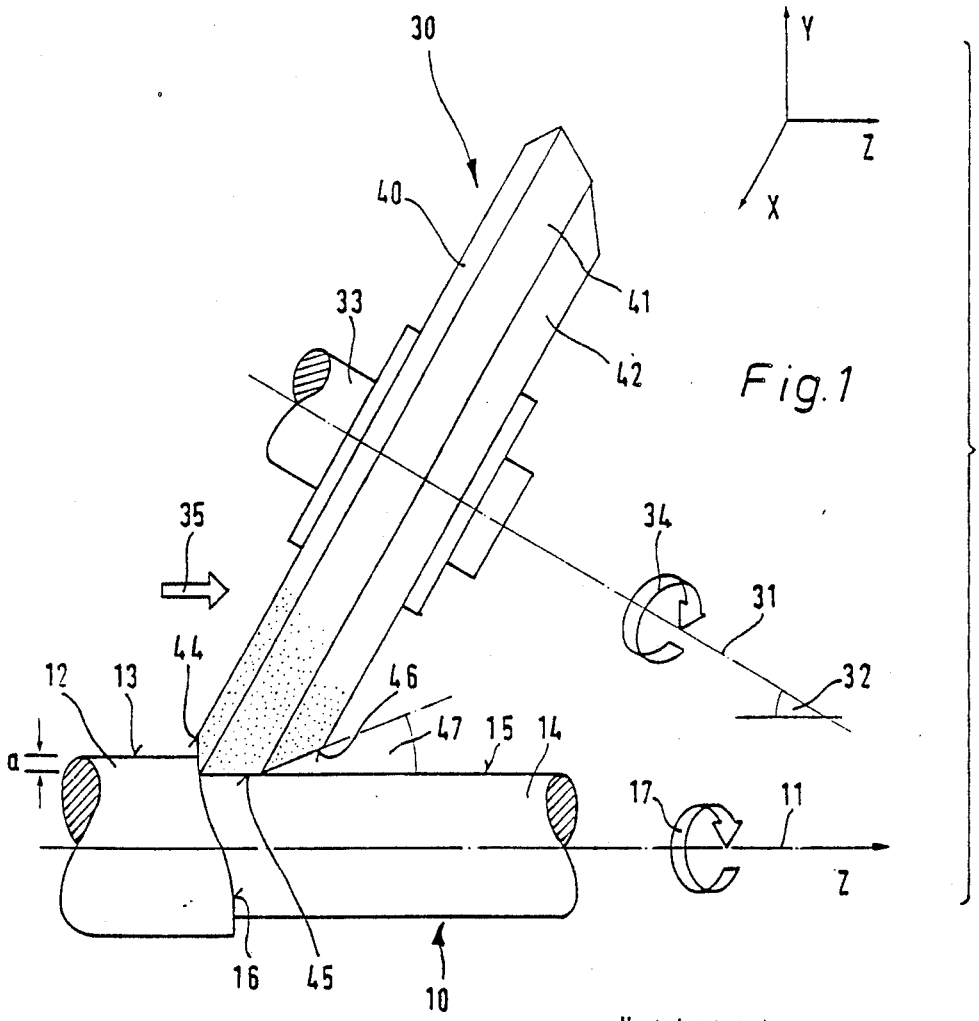
FIG. 1 shows a very diagrammatical top view illustrating the method according to the invention.

In FIG. 1, reference numeral 10 designates a rotational-symmetrical workpiece having a longitudinal axis 11. A first portion 12 of the workpiece 10 comprises a first circumferential surface 13 of a raw dimension, a second portion 14 of the workpiece 10 is already finished, and its second circumferential surface 15 exhibits the desired final dimension.

Between the portions 12 and 14, one can see a helicoidal material-removal surface 16, the oversize being indicated at a.

The workpiece 10, which has a diameter ($d_w$), can be rotated about an axis 11 in the direction indicated by a first arrow 17 (z axis), the rotational speed selected for the purposes of the present invention corresponding to a circumferential speed of 65 to 200 m/s for workpiece diameters ($d_w$) of 5 to 250 mm the arrow 17 representing any conventional, well known in the art, apparatus for providing a means to rotate the workpiece 10.

The workpiece 10 can be displaced relative to a grinding wheel 30. Preferably, the workpiece 10 is displaced axially in the direction indicated by a second arrow 35, the arrow 35 representing any conventional, well known in the art, apparatus for providing a means for displacing the workpiece 10 relative to the grinding wheel 30. The speed of feed $v_{fa}$ of the workpiece 10 is equal to approx. 150 to 2000 mm/min. The coordinate system x-y-z usually employed is likewise shown in FIG. 1.

The grinding wheel 30 comprises an axis 31 which is inclined relative to the axis 11 of the workpiece 10 by an angle 32 in the range of 30° (preferable 26°34'). The grinding wheel 30 is supported by a shaft 33 which can be driven to provide means for rotating the grinding wheel 30 about the axis 31 in the direction indicated by a third arrow 34.

If the grinding-wheel diameter is in the range of 600 mm, the speed of the grinding wheel 30 is adjusted to a value which leads to a circumferential speed ($v_s$) in the range of 100 to 300 m/s.

The grinding wheel 30 is provided with a first conical portion 40 as main cutter face, a second conical portion 41 as a secondary cutter face, and a third conical portion 42, starting from its radial end faces.

The first and the second conical portions 40, 41 define between them an angle of 90°, while the third conical portion 42 extends at a lightly flatter angle than the second conical portion 41.

As can be clearly seen in FIG. 1, the grinding wheel 30 engages the workpiece 10 in such a manner that a first surface 44 of the first conical portion 40 (main cutter face) is in contact with the helicoidal material-removal surface 16, and a second surface 45 of the second conical portion 41 is in contact with the second, finished circumferential surface 15 of the workpiece 10. Due to the flatter angle of the third conical portion 42, its third surface exhibits a relief angle 47 relative to the second, finished circumferential surface 15.

The arrangement is such that the second surface 4645 of the second conical portion 41 (secondary cutter face) is in contact with the second, finished circumferential surface 15 of the workpiece 10 over an axial length ($l_N$).

It is now possible to define a contact ratio (u) corresponding to the quotient between the axial length ($l_N$) between the second surface 45 and the feed in the direction of the third arrow 35, the feed being in turn equal to the quotient between the speed of feed ($v_{fa}$) and the rotational speed of the workpiece.

Figure 2:
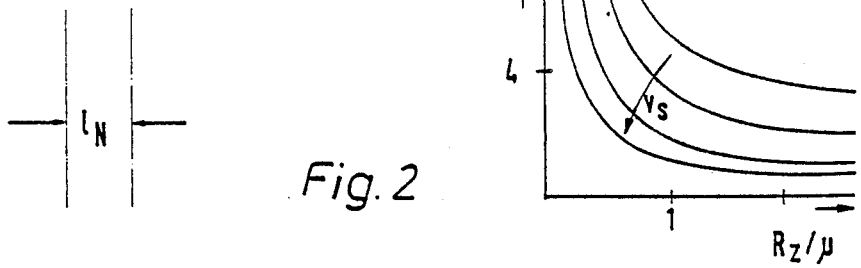
FIG. 2 shows a set of curves illustrating the empirically determined relationship between the contact ratio (u), and the surface roughness ($R_z$) and the circumferential speed of the grinding wheel ($V_s$).

The contact ratio (u) so defined provides a direct measure for the surface roughness ($R_z$) achievable when the circumferential speed ($v_s$) of the grinding wheel (30) is also considered for this purpose. The relation between the contact ratio (u) and the surface roughness ($R_z$) can be illustrated, using the circumferential speed ($v_s$) of the grinding wheel 30 as a parameter, by a set of curves of the type shown by way of example and very diagrammatically in FIG. 2. It can be clearly seen in FIG. 2 that the surface roughness ($R_z$) improves, i.e. reduces, as the contact ratio (u) and the circumferential speed ($v_s$) of the grinding wheel 30 rise.

Now, when a specific surface quality of the workpiece is desired, the contact ratio (u) can be determined from the desired roughness ($R_z$), giving due consideration to the circumferential speed ($v_s$) of the grinding wheel 30. The contact ratio (u) so determined is now inserted into the formula $$l_N = U \cdot q \cdot \frac{\pi\, d_w}{6 \cdot 10^4} \cdot \frac{v_{fa}}{v_s}$$

One obtains in this manner the axial length ($l_N$) which is just necessary in order to achieve the surface roughness ($R_z$), considering the given operation parameters, i.e. the circumferential speed ($v_s/v_w$) of the grinding wheel 30 and the workpiece 10, the workpiece diameter ($d_w$) and the speed of feed ($v_{fa}$). It must, however, be considered in connection with the before-mentioned formula that the auxiliary value (q) mentioned therein corresponds to the quotient ($v_s/v_w$) between the circumferential speed of the grinding wheel 30 and the workpiece 10.

It is understood that the method described above is meant only as an example for cases where the axial length ($l_N$) of the second surface 45 has to be determined and set for a given surface roughness ($R_z$). However, it goes without saying that other combinations of process parameters may also be given or adjusted according to the method of the invention, using the empirical relationships and formulas described above for determining mutually the lacking parameters, without leaving the scope and intent of the present invention.

What is claimed is:

1. A method of grinding a cylindrical surface of a workpiece extending along a first axis, comprising of:

determining a diameter ($d_w$) of said cylindrical surface;

rotating said workpiece about said first axis at a predetermined first peripheral speed ($V_w$) in a first direction of rotation;

rotating a grinding wheel about a second axis, said second axis being inclined to said first axis, said grinding wheel being rotated at a second peripheral speed ($V'_s$) in a second direction opposite to said first direction, said grinding wheel having a first and a second conical peripheral surface section, said first surface section engaging an essentially radial helicoidal cutting surface and said second surface section engaging an essentially axial surface section of said cylindrical surface;

displacing said workpiece and said grinding wheel relative to each other at a predetermined feed speed ($V_{fa}$) in a direction parallel to said first axis;

selecting a desired roughness ($R'_z$) of said cylindrical surface after completion of grinding;

determining an overlap factor (U') of said grinding wheel from emperically generated curves of overlap factor (U) as a function of roughness ($R_z$) and second peripheral speed ($V_s$) using the selected roughness ($R'_s$) and second peripheral speed ($V'_s$);

setting an axial length ($l_n$) of said essentially axial surface section from the overlap factor (U') according to the formula:

$$l_N = U' \cdot q \cdot \frac{\pi \cdot d_w}{6 \cdot 10^4} \cdot \frac{v_{fs}}{v_s}$$

where (q) is the ratio ($V'_s/V_w$) of said second and said first peripheral speeds.

2. The method of claim 1, wherein the following range of values are set:

$d_w$=5 to 250 mm $V'_s$=100 to 300 m/s $v_w$=65 to 200 m/min $v_{fa}$=150 to 2000 mm/min.

3. An apparatus for grinding a cylindrical surface of a workpiece to a preselected diameter ($d_w$) and a preselected roughness ($R'_z$) along a first axis, comprising:

first means for rotating said workpiece about said first axis at a predetermined first peripheral speed ($V_w$) in a first direction of rotation;

second means for rotating a grinding wheel about a second axis, said second axis being inclined to said first axis, said grinding wheel being rotated at a second peripheral speed $V'_s$ in a second direction opposite to said first direction, said grinding wheel having a first and a second conical peripheral surface section, said first surface section engaging an essentially radial helicoidal cutting surface and said second surface section engaging an essentially axial surface section of said cylindrical surface;

third means for displacing said workpiece and said grinding wheel relative to each other at a predetermined feed speed ($V_{fa}$) in a direction parallel to said first axis;

empirical curve means for determining an overlap factor (U) of said grinding wheel from said roughness ($R'_z$) and said second peripheral speed ($V'_s$), said empirical curve means comprising a set of curves representing the overlap factor (U) as a function of roughness ($R_z$) and second peripheral speed ($V_s$), said empirical curve means thereafter enabling the calculation of an axial length ($l_n$) along which the second surface makes contact with the axial surface section of the cylindrical surface according to the formula:

$$l_N = U \cdot q \cdot \frac{\pi \cdot d_w}{6 \cdot 10^4} \cdot \frac{v_{fa}}{v_s}$$

where (q) is the ratio ($V_s/V_w$) of said second and said first peripheral speeds.

4. The apparatus of claim 3, wherein the following range of values are set:

$d_w$=5 to 250 mm $V'_s$=100 to 300 m/s $v_w$=65 to 200 m/min $v_{fa}$=150 to 2000 mm/min.

* * * * *